US005447388A

United States Patent [19]

Rouse

[11] Patent Number: 5,447,388

[45] Date of Patent: Sep. 5, 1995

[54] MODULAR ASPHALTIC PAVING RUBBER BLENDING UNIT AND METHOD

[76] Inventor: Michael W. Rouse, P.O. Box 820369, Vicksburg, Miss. 39182-0369

[21] Appl. No.: 128,638

[22] Filed: Sep. 29, 1993

[51] Int. Cl.[6] ..... E01C 7/26

[52] U.S. Cl. ..... 404/72; 404/84.05; 404/101; 404/108

[58] Field of Search ..... 404/70, 72, 75, 79, 404/80

[56] References Cited

U.S. PATENT DOCUMENTS

| | | | |
|---|---|---|---|
| 4,069,182 | 1/1978 | McDonald | 404/72 |
| 4,272,212 | 6/1981 | Bauer, Jr. et al. | 404/72 |
| 5,044,819 | 9/1991 | Kilheffer et al. | 404/72 |

*Primary Examiner*—Ramon S. Britts
*Assistant Examiner*—Pamela A. O'Connor
*Attorney, Agent, or Firm*—Foley & Lardner

[57] ABSTRACT

A process and apparatus for continuous batch operation for producing an elastomeric asphaltic compound of rubber and asphalt for paving purposes comprising an essentially cylindrical mixing tank containing rotary internal agitators, preferably at three levels within the tank. The apparatus is equipped with a asphalt oil pump, which flows asphalt oil through a pre-heater into the mixing tanks, and with a separate spiral or screw conveyor for loading through the top of the tank a continuous supply of fine rubber at a controllable feed rate. The entire tank is suspended upon a frame supported by load cells so as to provide a continuing measurement of the total weight of the asphalt load and of the added rubber. The temperature of the asphalt oil raised by the preheater until substantially all the asphalt oil reacts with the rubber in the time required to flow the mixture through the stirring tanks, providing a continuous flow process for providing paving grade asphalt rubber mixtures.

6 Claims, 4 Drawing Sheets

MODULAR ASPHALTIC PAVING RUBBER BLENDING UNIT AND METHOD

BACKGROUND OF THE INVENTION

This invention relates to equipment for preparing asphaltic rubber mixes for use in paving.

It is known that asphalt rubber mixes are beneficial as elastomeric paving materials. Mixtures of rubber and asphalt have been used extensively for over one hundred years in an effort to combine the resiliency and wear resistance of the rubber with the strength of asphalt. Examples are shown in U.S. Pat. Nos. 2,310,972; 2,700,655; 2,578,001; 3,049,836; 3,253,521; 3,270,631; 3,338,849; 3,340,780 and 3,844,668.

Various mixtures have been tested but a typical prior art mixture is shown in McDonald U.S. Pat. No. 3,891,585 and Winters, et al, U.S. Pat. No. 3,844,668. These mixtures, and all prior art high rubber content rubber asphalt compounds have been characterized by high viscosities, a gel like state, lengthy processing times to form the mixture and relatively short pot life for the resulting mixture These patents reveal various processes for mixing asphalt and rubber, but the basic steps known are to mix asphalt from 350 to above 500 degrees fahrenheit, mixing in ground rubber in a high shear mixer which physically abrades the rubber particles to produce reacted product, and then holding the mixture at that temperature until the rubber is substantially reacted with the asphalt. Reported times for this prior art reaction are about one-half to one hour after rubber induction to form the material which at its end point is reported to have an extreme viscosity, between 2,000 to about 50,000 centipoise, but ranging as high as 150,000 to 200,000 centipoise. Special equipment is reported to be required to handle the resulting mixtures.

SUMMARY OF THE INVENTION

It has been found as disclosed in my co-pending patent application Ser. No. 07/822,292, incorporated herein by reference, that if finely ground vulcanized rubber particles, having a coarse abraded surface from grinding between abrasive stones, are intermixed with hot asphalt at a temperature of between 300 and 350 degrees that in between five and ten minutes a freely flowing, fully combined Rubber Asphalt mixture is produced, having no perceptible Gel state, and a displaying an extremely long pot life. For example, in the case of ten percent rubber ground to pass an 80 mesh screen added to AC30 asphalt at 300 degrees, the viscosity drops to 10,000 centipoise and at 355 degrees drops and remains steady at approximately 2,500 centipoise without the addition of solvent. Within this temperature range and for amounts of rubber ranging from zero up to ten percent, the end working viscosity for the rubber asphaltic mix is reached in under ten minutes.

I have discovered that by controlling the temperature of the asphaltic oil component, that the asphalt and rubber may be mixed continuously in a non-shear mixer, producing a continuous flow of fully reacted Rubber Asphalt which may be pumped onto a storage or distribution tanker for subsequent use. The preferred mixer is a trailer borne unit having an inlet asphalt pump for drawing asphalt from a delivery tank. The asphalt then passes through a flame driven heater which is set to produce a continuous flow of asphalt at a set temperature at the flow rate established by the pump. The asphalt then flows into a rapid mixer: a series of tanks having internal rotating paddles for stirring. Finely ground rubber is added at a controllable rate by a constant volume screw conveyor from an entry hopper to the first mixing tank.

The rapid mixer tanks are suspended on a floating frame supported by load cells so as to provide a continuing measurement of the total weight of an asphalt load and of added rubber; this measurement serves to guide the operator in setting the relative flow rate of the asphalt pump, and the rotation rate of the screw conveyor to achieve a desired percentage rubber addition. Each tank is surrounded with a thermal fluid heat jacket for maintaining the tank and its contents at between 300 and 350 degrees fahrenheit. Where more than one tank is employed, the tanks are interconnected to permit the flow through of liquified rubber asphalt compound.

In use, the tank is initially loaded with a charge of preheated asphaltic oil as monitored by the load cell weighing. A desired quantity of rubber, matching the initial asphalt charge, is then added by weight, the addition monitored by the increase in weight as reflected in the load cell. Agitation is begun and after a short period determined by the pre-heat temperature, the resulting mixture is then totally reacted. The outlet may then be opened and, as the reacted mixture is pumped out, measured volumes of asphalt and rubber are added to the mixing tanks. The rate at which the asphalt is pumped determines the throughput flow rate, and therefore the time the mixture remains in the mixing tanks. A continuous production of the reacted mixture can be maintained by control of the pump rate and heater temperature so that the reaction time is less than the time for the asphalt to flow through the process.

The time available for mixing and reaction is determined by the volume of the mixing tanks and the pump rate of the input asphalt pump. The reaction rate is controlled to insure full reaction by varying the temperature of the asphaltic oil by means of the input preheater.

The reacted compound may be readily pumped from the final mixing tank to a transportation tank, or into a distribution truck to be directly applied to pavement as a sealing coat or an intermediate membrane layer.

Other additives can also be added stoichiometrically in parallel with the rubber and blends with the asphaltic cement. For example, Liquid SBR Latex, Neoprene Latex, Geo Textiles or other liquid or solid additives or waste materials such as waste oil, ethylene glycol may be added.

The weight scale acts as a high-low level control indicator on the tank.

The system can be operated in a batch or continuous mode. It can directly fill an on site storage system or be fed to a transport truck. Alternately, it can feed directly into a hot mix asphalt plant system or to a spreader truck.

It is thus an object of the invention to disclose a mixing device which can field mix an elastomeric asphalt rubber compound with a very short reaction time and in quantities as required for immediate usage.

It is a further object of the invention to show a truck mounted elastomeric asphalt rubber mixing unit which may be readily moved to a point of need in the field for the mixing of required quantities of an elastomeric asphalt paving compound.

It is a further object of the invention to show an apparatus capable of reacting a rubber asphalt mixture to form an elastomeric paving compound within a controlled short period of time.

It is a further object of the invention to show a rubber asphalt blending device which controls the rate of reaction by temperature control of the asphalt to meet desired processing and reaction rates.

It is a further object of the invention to show a process for on site continuous production of fully reacted rubber asphalt mixtures for paving compounds.

These and other objects of the invention may be more readily seen from the detailed description of the preferred embodiment which follows.

DETAILED DESCRIPTION OF THE PREFERRED EMBODIMENT

Figure 1:
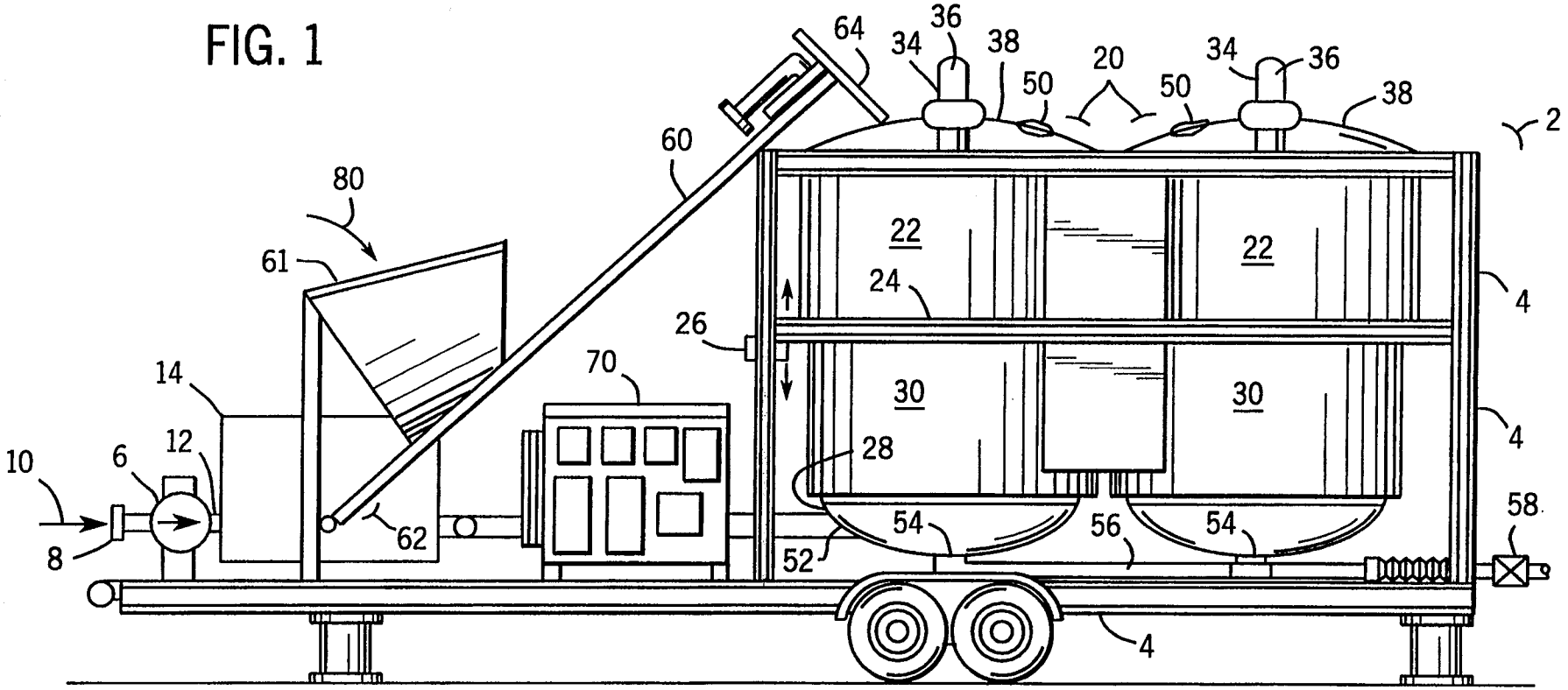
FIG. 1 is a view of one embodiment of the invention
Figure 2:
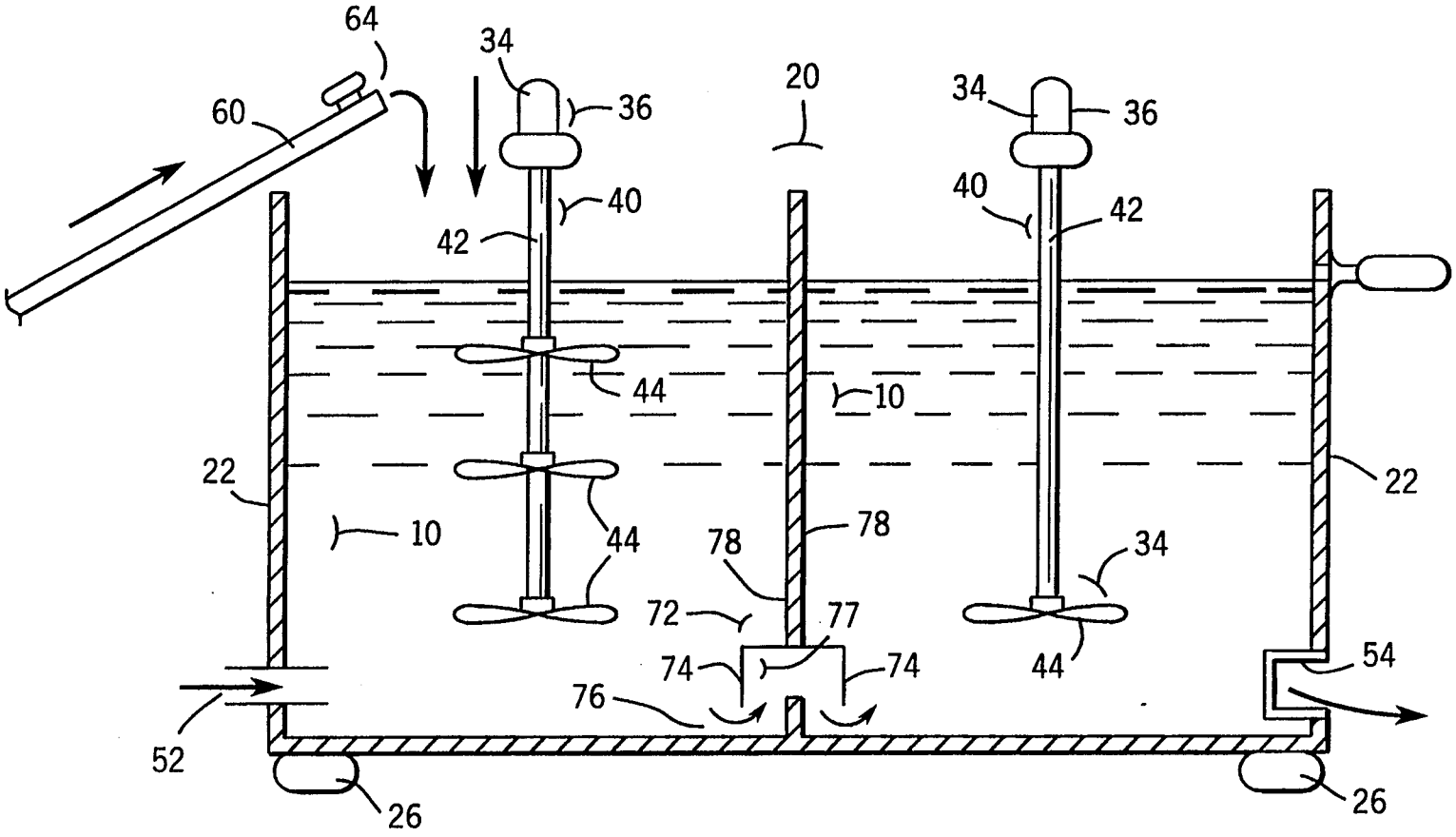
FIG. 2 is a cut away view of the mixer subassembly of the invention.
Figure 3:
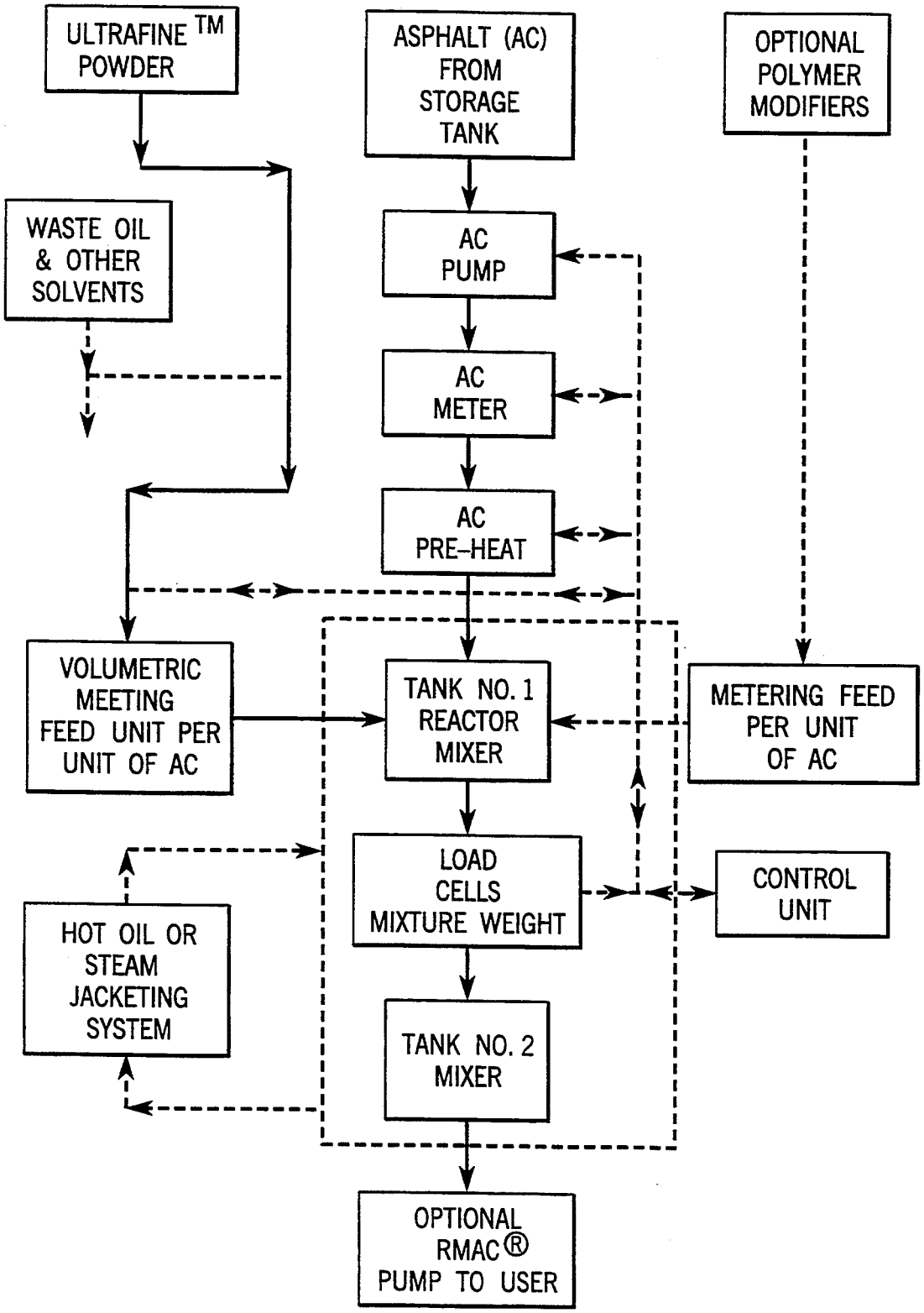
FIG. 3 is a flow chart of the invention.
Figure 4:
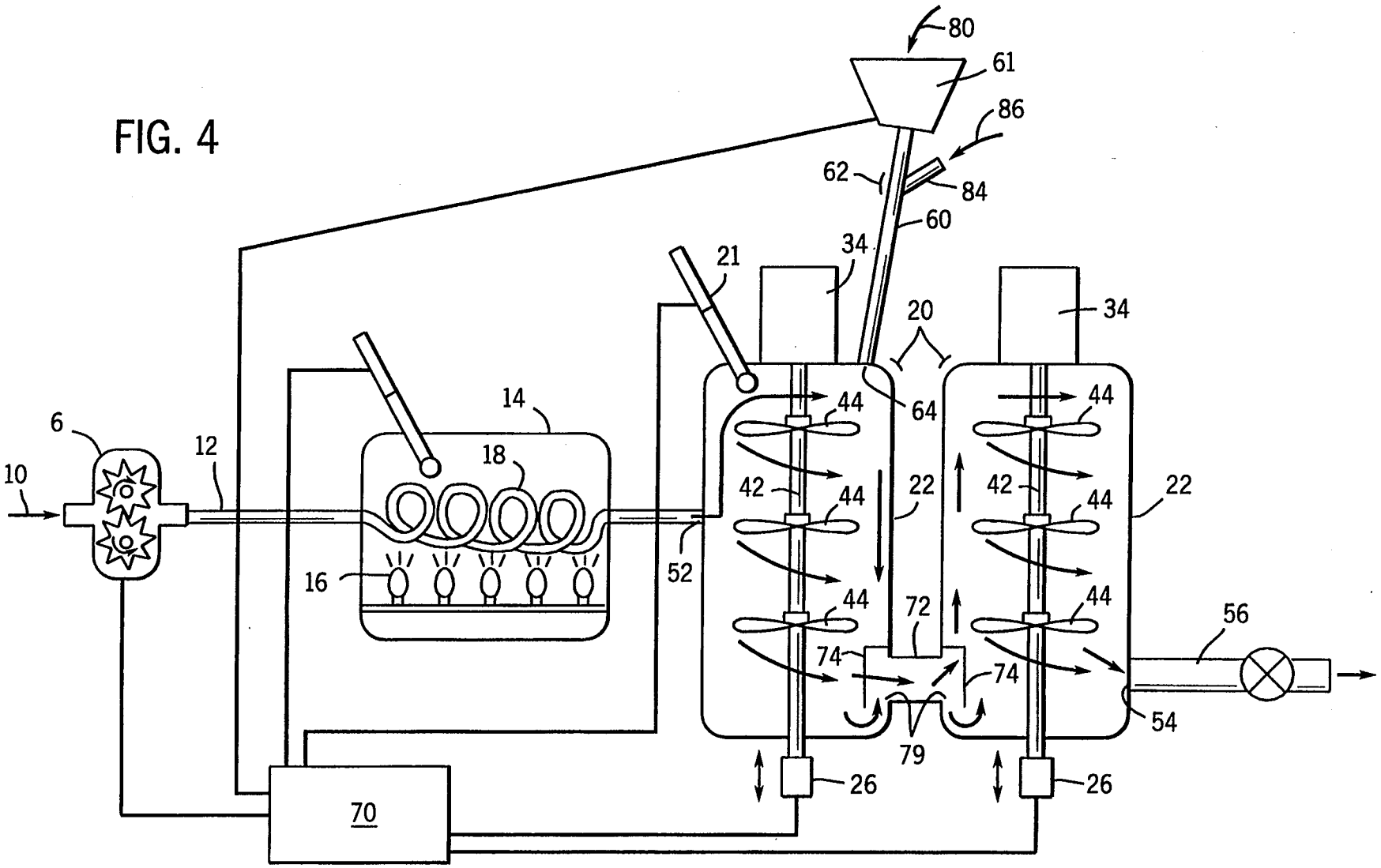
FIG. 4 is a pictorial schematic of the invention.

The drawings show an exemplar unit (2). For convenience the entire mixing unit (2) is trailer (4) mounted for positioning at asphalt terminals or other sites where production of blended asphalt rubber mixtures is desired.

On the rear of the trailer (4) is mounted first an asphalt pump (6), electrically driven, which connects from a standard hose connection (8) for accepting liquid asphalt (10) from a storage tank or shipping tank. The pump outlet (12) is fluidly connected to a flame heater (14). A typical such heater (14) is a hot oil heater, which burns (16) diesel oil to heat asphalt pumped in internal piping (18) through the heater (14). A suitable unit is a Heatec asphalt booster heater, manufactured by Heatec, Inc. of Chattanooga, Tenn. Typically the heater (14) is specified to produce a temperature rise of about 50 degrees F at the maximum flow rate of the pump (14); for the exemplar unit (2) the heater (14) can produce a 50 degree temperature rise in the asphalt at 75 gallons per minute flow.

From the heater (14), the heated asphalt flows into a low shear, rapid mixer (20) sub-assembly. Internal temperature sensors (21) in the rapid mixer tanks (20) permit monitoring of the asphalt temperature.

The rapid mixer (20) subassembly of the invention has at least one vertical cylindrical tank (22) mounted fixedly to a floating frame (24) which is supported by a plurality of weight sensing means (26) or load cells (26) in a suspended condition, with the load cells being firmly affixed to a wheel mounted trailer frame (4) or truck body.

Surrounding at least the bottom half (28) of each cylindrical mixing unit (22) is an enclosing heat jacket (30) containing a plurality of pipe connected for flow to a source (32) of hot oil at a temperature of about 350 to 400 degrees fahrenheit. This heat jacket (30) is not intended to raise the temperature of the tank contents, but serves to compensate for heat loss from the tank (22) by conduction and radiation so that the heated mixture does not cool during mixing.

At the top of each mixing tank (22), is an axially mounted, motor driven rotary agitator (34) unit comprising, in the preferred invention, an electric motor (36) mounted to a fixed cross beam structure forming the lid (38) of the mixing tank (22). Descending axially along the center line of the mixing tank (22) cylinder into the mixing tank is a rotary agitator (40) assembly comprising an agitator axle (42) from which extend elongate radial paddles (44) of a generally thin appearance with respect to their length but sufficiently thick to resist the forces of being moved within asphalt. The paddles (44) provide a stirring action to the contents of the mixing tank (22), but do not provide any shearing action; therefore, the drive and paddles (44) must withstand only relatively low stresses in mixing. This mixing action is distinct from the high shear mixers of prior art rubber asphalt blenders; in high shear mixers, the physically break up or de-polymerize the rubber particles.

Preferably the agitator blades (44) are located at least three levels within the tank (22), one set of blades proximate the tank, one set of blades at a mid-level of the tank and one set of blades near the top of the tank. Single agitators (34) of proper design and speed can also be used.

Access hatches (50) are provided within the lid (38) to permit access to and inspection of the interior of the tank.

The tank (22) contains a first pipe inlet (52), which may be located in either in the top or the bottom of the tank; this inlet (52) is connected through valves and plumbing to the asphalt pre-heater (14) outlet, which forms an external source of liquified heated asphaltic oil under pressure. A rigid section of pipe is connected to the tank (22); it ends in a floating connector to which a flexible section of pipe may be interconnected to the heater so as to permit the mixing tank to float relatively freely upon load cells without binding by the supplying pipe. An exit opening (54) is located in the bottom center of the mixing tank (22), connected through a valve and coupling to an outlet pipe (56), ending in a coupling face (58) for attaching a flexible hose for draining the reacted, mixed rubber asphalt paving compound.

A helical screw conveyor (60) is pivotally affixed at a bottom end (62) near one end of the fixed frame (4) of the unit and rises at an angle to an entry opening (64) at the top of the tank (22). The helical screw (60) may be pivoted at its bottom end (62) so as to be fully movable with motion of the mixing tank (22) or alternatively it may be affixed at the bottom end (62) to the floating frame (24). The helical screw (60) is designed to move a constant volume of material at a given turning rate, so that the feed rate of material may be set by varying the rotation rate of the screw. Thus it is not necessary to weigh the additives to be mixed with the asphalt, since feed rates are set by screw speed. Likewise, the inlet asphalt pump (6) speed sets the flow rate of the asphalt.

In use, a bulk supply of abrasively ground rubber (80), preferably finer than 40 mesh, is supplied to the hopper. This ground rubber 80 is preferably produced by the process described in my co-pending application referenced above; that is, the rubber is produced by abrasively grinding various scrap rubber stocks between abrasive grinding wheels in a comminuting mill. Such abrasively ground rubber has a high reaction rate with asphalt oil, forming a reacted mixture without the necessity of high shear mechanical mixing. When the material is so finely ground it also does not stratify in transport, and therefor the material may be shipped in bulk, and directly poured into the hopper (61). The rate of feed of the helical conveyor (60) determines the rate of feed of the ground rubber into the stirring tanks (22);

the hopper 61 merely serves as a holding reservoir for the feed supply of rubber.

Alternatively, means (84) may be provided within the helical screw (60) and hopper mechanism (61) for adding a reactive liquid or oil (86) to the particulate rubber compound (80) passed into the tank (22) through the helical screw (60). Adding the material (86) to the bulk rubber (80) takes advantage of the helical screw mechanism (60) in premixing the particulate rubber (80) and the optional oil or other reactive compound (86).

The floating frame (24) supporting the weight of the mixing tank (22) and its contents is supported on electric load cells (26) at one end and pivoted to the trailer frame (4) at the other end. The electric load cells (26) are fastened to the frame (4) of the truck or trailer. The weight of the mixing tanks (22) and their contents thus bears against the load cells (26).

A control panel (70) upon the fixed frame (4) contains electrical controls for operating the motor of the agitator (34); the helical screw (62) conveyor and, optionally, electrically operated valves. Equally, manual valves may be used as described below.

In an alternate form of the invention, a plurality of stirring tanks (22) are joined side to side upon the floating frame (24). The first stirring tank (22) is connected as described, the subsequent stirring tanks are connected through a siphon baffle (72) between the tanks. Each such baffle is formed from a first baffle plate (74), spaced from and mounted to the side of the tank (22) at its bottom. This baffle plate (74) has an opening (76) at the bottom but otherwise forms a closed chamber (77) against the tank side (78). A corresponding baffle (74) is mounted on the side of the second tank (22) in opposed position to the first baffle (74), and an opening (79) in the two tanks walls, forming a fluid connection between the tanks (22), completes the siphon baffle (72). This forms an inverted U siphon between the first and the second mixing tank (22) which will fill when the low viscosity elastomeric mix becomes fluid and will flow until the first tank is completely emptied into the second tank.

Each tank (22) is equipped with a rotary agitator of an identical design to the first tank. The last tank is equipped with the output line described above for the single tank system.

A multiple tank system may not be necessary with the proper temperature agitation profile in a single tank. The reaction time in the mixer is determined by the volume of the tanks and the flow rate of the asphaltic oil pump, which determines the flow rate of the system. Multiple tanks provide a simple way to increase the volume of the rapid mixer while retaining the overall size of the trailer mounted equipment within reasonable limits.

A previously existing problem in the prior art is that coarse crumb rubber particles will stratify out during transportation, as vibration separates them into stratified layers of denser or lighter particles. This requires that the crumb rubber of the prior art be bagged in small quantity so that a uniform particle size will be introduced into the mixing process. It has been found that by using particles of the preferred size, which are much finer than have been previously used in the art for intermixing with asphaltic oils,that this problem is eliminated. With fine particles of 40 mesh or greater fineness, it has been found that stratification of the particles during transportation does not occur. This permits finely ground rubber, for the first time, to be transported in bulk and added directly from a bulk conveyor or bulk transporter to the hopper. The previously existing problems caused by particle size stratification simply do not seem to occur with the fine mesh particles, and despite transportation and holding in bulk, a uniform range of particle sizes is constantly presented directly from the bulk transport and may be directly deposited into the hopper to be conveyed into the reactor.

Further, use of the helical conveyor permits fine control of the rate of addition, by weight, of ground rubber to the asphaltic cement. Finely ground rubber particles being of a substantially uniform density may be controlled and measured either by volume or by weight. By supporting the entire mixing tank mechanism upon weight sensitive load cells, the process operator can at all times maintain control over the total quantity of asphaltic cement being reacted and the rate and total quantity of ground rubber being added to the mixture. The total quantity of asphalt and rubber is monitored by weight by the load cell permitting control of the process throughout.

At typical flow rates within the mixer, the time required for the asphalt and rubber mixture to mix at 375 degrees F. is three to five minutes of agitation time. An essentially continuous flow process may be maintained, creating a continuous batch of elastomeric rubber asphalt paving material on site and as demanded by control of pump rate to control dispensing rate, and control of pre heater temperature to establish a reaction rate to match the dwell time of the mixture in the rapid mixer at the desired pump rate.. An inline viscometer can be used to monitor the rubber asphaltic mixture when exiting the system to confirm full reaction of the components. The process is insensitive to asphalt shipping temperatures, and therefore loss of heat in asphalt transportation apparatus no longer affects mixing rates of Rubber Asphalt paving blends.

I claim:

1. An apparatus for reacting rubber with asphalt to form rubber asphaltic paving compounds in a continuous flow comprising:

a frame, a mixing tank mounted on said frame, means for supplying a continuous flow of asphalt to said tank;

means for heating said asphalt to a temperature greater than 350° F. prior to entering said tank, means for supplying a controlled volume of ground particulate rubber finer than 40 mesh to said tank;

said tank containing means for agitating said asphalt and said rubber at said temperature, whereby a reacted rubber asphalt compound is continuously produced, and means for output of said reacted rubber asphalt compound from said tank.

2. The apparatus of claim 1, further comprising:

a plurality of said mixing tanks, each sequentially interconnected for flow of reacted rubber asphalt compound.

3. The apparatus of claim 1, wherein:

said tank being mounted on a floating frame on said trailer;

said floating frame being mounted on a number of load cells for generating a signal responsive to the weight of the tank and its contents.

4. The apparatus of claim 2, wherein:

said tanks are mounted on a floating frame on said trailer; and said floating frame being mounted on a number of load cells for generating a signal responsive to the weight of the tanks and their contents.

5. The apparatus of claim 1 wherein said means for supplying a controlled volume of ground particulate rubber comprising a constant volume helical screw conveyor;

said means for supplying a flow of asphalt comprising a constant volume pump;

whereby the proportions of asphalt and rubber in said compound are determined by the supply rate of said pump and said screw conveyor.

6. A process for inline direct site mixing of asphalt rubber paving compounds comprising:

providing a source of liquid paving grade asphalt oil;

pumping said oil at a controlled volumetric rate through a heating means into a stirring means;

heating said asphalt oil to a temperature greater than 350° F.;

providing ground rubber particles finer than 40 mesh to said stirring means at a controlled volumetric rate;

stirring the heated oil with the ground rubber particles;

controlling the heating temperature to fully react the rubber and the asphalt oil during stirring;

delivering the reacted asphalt rubber mixture from an outlet at said controlled volumetric rate.

* * * * *